US011143171B2

(12) United States Patent
Winglee et al.

(10) Patent No.: US 11,143,171 B2
(45) Date of Patent: Oct. 12, 2021

(54) AIR-BREATHING PULSED PLASMA THRUSTER WITH A VARIABLE SPACING CATHODE

(71) Applicant: University of Washington, Seattle, WA (US)

(72) Inventors: Robert M. Winglee, Seattle, WA (US); Manuel Azuara Rosales, Seattle, WA (US); Corwin Hansen, Seattle, WA (US)

(73) Assignee: University of Washington, Seattle, WA (US)

( * ) Notice: Subject to any disclaimer, the term of this patent is extended or adjusted under 35 U.S.C. 154(b) by 309 days.

(21) Appl. No.: 16/506,804

(22) Filed: Jul. 9, 2019

(65) Prior Publication Data

US 2020/0263674 A1 Aug. 20, 2020

Related U.S. Application Data

(60) Provisional application No. 62/695,331, filed on Jul. 9, 2018.

(51) Int. Cl.
*F03H 1/00* (2006.01)

(52) U.S. Cl.
CPC ..... *F03H 1/0087* (2013.01); *F03H 1/0012* (2013.01)

(58) Field of Classification Search
CPC ..... F16H 25/14; F16H 25/08; F03H 1/0087; F03H 1/0012
See application file for complete search history.

(56) References Cited

U.S. PATENT DOCUMENTS 2,441,284 A 5/1948 Parrish
3,517,248 A 6/1970 Eckel
4,415,133 A 11/1983 Phillips
5,810,284 A 9/1998 Hibbs et al.
(Continued)

OTHER PUBLICATIONS

Rosales "Air-Breathing Pulsed Plasma Thruster with a Variable Spacing Cathode for Atmospheric Satellite Applications" (Year: 2017).*

(Continued)

*Primary Examiner* — Gerald L Sung
*Assistant Examiner* — William L Breazeal
(74) *Attorney, Agent, or Firm* — Christensen O'Connor Johnson Kindness PLLC

(57) ABSTRACT

An atmosphere-breathing pulsed plasma thruster includes an inlet, a discharge section with an anode in fluid communication with the inlet, and a nozzle in fluid communication with the discharge section. Electrode assemblies extend radially through the discharge section and include a second electrode in the discharge section and an elongate portion extending outwardly. An electrode control mechanism moves the plurality of electrode assemblies between an inner position nearer to the anode and an outer position farther from the anode. At least one igniter extends between the anode and a cathode. An ignition circuit connects the anode and the cathodes to a first source of electric energy, and connects the igniter to a second source of electric energy through a controllable switch. A processor controls the position of the second electrodes, for example, in response to changes in atmospheric pressure.

22 Claims, 6 Drawing Sheets

(56) References Cited

U.S. PATENT DOCUMENTS

| | | | |
|---|---|---|---|
| 6,834,492 | B2 | 12/2004 | Hruby et al. |
| 6,998,027 | B2 | 2/2006 | Chiu |
| 7,278,607 | B2 | 10/2007 | Fuller |
| 7,581,380 | B2 | 9/2009 | Wahl |
| 8,044,319 | B2 | 10/2011 | Prociw et al. |
| 8,322,650 | B2 | 12/2012 | Kelleher |
| 9,234,510 | B2 | 1/2016 | Vial et al. |
| 10,308,346 | B2 | 6/2019 | Parks et al. |

OTHER PUBLICATIONS

Wikipedia "Servomotor" (Year: 2017).*

Neumann "A centre-triggered magnesium fueled cathodic arc thruster uses sublimation to deliver a record high specific impulse" (Year: 2016).*

Johnson, I.K., et al., "Pulsed Plasma Thrusters for Atmospheric Operations," AIAA Propulsion and Energy Forum, 50th AIAA/ASME/SAE/ASEE Joint Propulsion Conference, Cleveland, Ohio, Jul. 28-30, 2014, pp. 1-10.

Schönherr, T., and K Komurasaki, "Analysis of Atmosphere-Breathing Electric Propulsion," presented at the 33rd International Electric Propulsion Conference, The George Washington University, Washington D.C., Oct. 6-10, 2013, pp. 1-11.

Arrington, L.A., et al., "A Performance Comparison of Pulsed Plasma Thruster Electrode Configurations," Prepared for the 25th International Electric Propulsion Conference Sponsored by the Electric Rocket Propulsion Society, Cleveland, Ohio, Aug. 24-28, 1997, 10 pages.

Azuara Rosales, M.A., et al., "Air-Breathing Pulsed Plasma Thruster With a Variable Spacing Cathode for Atmospheric Satellite Applications," AIAA Propulsion and Energy Forum, 53rd AIAA/SAE/ASEE Joint Propulsion Conference, Atlanta, Georgia, Jul. 10-12, 2017, 8 pages.

Burton, R.L, and P.J. Turchi, "Pulsed Plasma Thruster," J. Propulsion and Power 14(5):716-735, Sep.-Oct. 1998.

Di Cara, D., et al., "RAM Electric Propulsion for Low Earth Orbit Operation: An ESA Study," Presented at the 30th International Electric Propulsion Conference, Florence, Italy, Sep. 17-20, 2007, 8 pages.

Husain, E., and R.S. Nema "Analysis of Paschen Curves for Air, N2 and SF6 Using the Townsend Breakdown Equation," IEEE Transactions on Electrical Insulation EI-17(4):350-353, Aug. 1982.

Keswani, D., and P. Sharma, "Google's Project Loon," International Journal of Control Theory and Applications 9 (17):8399-8406, 2016 (abstract), <https://www.researchgate.net/publication/312060908_Google's_project_Loon> [retrieved Feb. 7, 2020].

Magnusen, S., "Air Force Explores Balloon-Assisted Launches," Space News, Jan. 21, 2003, <https://web.archive.org/web/20080429193419/http://www.space.com/spacenews/archive03/balloonarch_012103.html> [retrieved Feb. 7, 2020], 3 pages.

Mazouffre, S., et al, "Ionization and Acceleration Processes in a Small, Variable Channel Width, Permanent-Magnet Hall Thruster," J. Phys. D: Appl. Phys. 45 185203, Apr. 2012, 7 pages.

Noll, T.E., et al., "Investigation of the Helios Prototype Aircraft Mishap," vol. I, Mishap Investigation Report, NASA Langley Research Center, Hampton, Virginia, Jan. 2004, 100 pages.

Northway, P.E., et al., "Pulsed Plasma Thruster Gains in Specific Thrust for CubeSat Propulsion," AIAA Propulsion and Energy Forum, 53rd AIAA/SAE/ASEE Joint Propulsion Conference, Atlanta, Georgia, Jul. 10-12, 2017, 6 pages.

Palumbo, D.J., and Guman, W.J., "Effects of Propellant and Electrode Geometry on Pulsed Ablative Plasma Thruster Performance," J. Spacecraft 13(3):163-167, Mar. 1976.

Schönherr, T., et al., "Analysis of Atmosphere-Breathing Electric Propulsion," IEEE Transactions on Plasma Science 43(1):287-294, Jan. 2015.

* cited by examiner

AIR-BREATHING PULSED PLASMA THRUSTER WITH A VARIABLE SPACING CATHODE

CROSS-REFERENCE TO RELATED APPLICATION

This application claims the benefit of Provisional Application No. 62/695,331, filed Jul. 9, 2018; the entire disclosure of said application is hereby incorporated by reference herein.

BACKGROUND

The cost of communications and remote sensing, for example, could be greatly reduced with a station-keeping high-altitude platform developed to stay at altitude for long periods. A high-altitude air-breathing pulsed plasma thruster (AB-PPT), suitable for propelling a long-endurance aerial vehicle is disclosed. The AB-PPT includes a system for adjusting the spacing between the electrodes that enables the AB-PPT to operate efficiently over a broad range of altitudes. For example, the AB-PPT may be configured to operate between 40,000 to 90,000 ft, and to use solar energy as a power source, and batteries and/or capacitor banks for energy storage.

At high altitudes, for example in or above the tropopause, air density is generally too low for conventional propellers to operate. The air density is, however, sufficient to contemplate a propulsion system that uses the available atmospheric gases as a propulsive reaction mass (propellant). Varying atmospheric pressure presents hurdles to the development of a propulsion system that can efficiently operate at such altitudes. A propulsion system capable of efficiently operating in low air pressure regions would enable controlled access to atmospheric altitudes not accessible with conventional technology (e.g., propeller technologies). An efficient propulsion system capable of functioning using in-situ propellant (the local atmosphere) to propel an aircraft at these altitudes would enable an "atmospheric satellite," i.e., an aircraft configured to operate at altitude for extended periods of time. An efficient atmospheric satellite would provide the opportunity for significant cost savings and flexibility relative to orbiting spacecraft.

In another application a reaction engine capable of operating in a low-pressure atmosphere would enable new modes for planetary exploration in atmospheric regions having low pressure, for example on Mars or the upper atmosphere of Venus or Titan.

Prior efforts to develop high-altitude atmospheric vehicles, for example altitudes greater than about 25 km, have been considered. However, these prior designs are typically propeller-driven. For example, in 1999 under the Environmental Research Aircraft and Sensor Technology (ERAST) program, NASA developed an electric-powered propeller-driven aircraft referred to as Helios Prototype that used solar panels driving 10-14 electric motors, for high altitude, low atmospheric pressure operation. Helios Prototype reached a maximum atmospheric altitude of 29.5 km and remained above 29 km for approximately 40 minutes. The aircraft was destroyed due to structural failure, falling into the Pacific Ocean in 2003. Efforts to develop electric, propeller-driven aircraft continue.

High altitude, long duration aircraft are known in the art. For example, U.S. Pat. No. 5,810,284, to Hibbs et al., which is hereby incorporated by reference in its entirety, discloses a solar rechargeable aircraft that is able to remain airborne "almost indefinitely." However, Hibbs et al. discloses using propellers driven by a.c. motors, which presents challenges for high altitude operation. U.S. Pat. No. 7,278,607, to Fuller, which is hereby incorporated by reference in its entirety, discloses a solar-powered aircraft that uses onboard water to produce hydrogen that is used both to increase the buoyancy of the aircraft and to produce energy with onboard fuel cells, and again relies on propellers for propulsion. U.S. Pat. No. 8,322,650, to Kelleher, which is hereby incorporated by reference, discloses another embodiment of a propeller-driven, high altitude, long endurance aircraft using electric motors.

Various electric thruster systems are known. For example, the pulsed plasma thruster (PPT) is more than 50 years old. Compared to other electric propulsion (EP) systems such as Ion and Hall thrusters, the PPT is an attractive EP technology offering low mass, low cost, simplicity, and robustness. A PPT generates thrust through pulses at a controllable frequency. The PPT is a throttle-suitable device when compared to other EP systems, allowing throttling by regulating the energy per discharge and/or the frequency of the discharge. This characteristic is of particular interest for atmospheric applications. Due to the pulsed nature of the system, PPTs are not subject to a continuous flow condition, enabling the discharge region to refill between pulses through normal airflow and no compressors or other similar equipment is needed, which is a significant mass savings. Additionally, the high electric field that pulsed devices use facilitates the breakdown of air in thin atmosphere.

The PPT has historically been used for orbital, non-atmospheric applications. Research has focused on developing more efficient systems for applications using an onboard propellant, such as station keeping, orbiting, drag compensation, deep space mission, etc. For example, in a paper titled "Pulsed Plasma Thrusters for Atmospheric Operation," co-authored by one of the present inventors, and hereby incorporated by reference in its entirety ($50^{th}$ AIAA/ASME/SAE/ASEE Joint Propulsion Conference dated Jul. 28-30, 2014), a PPT for atmospheric operation is described.

The AB-PPT adapts traditional PPT technology to provide propulsion for vehicles capable of operating in atmospheric altitudes, for example altitudes of 20 km and greater, and using the atmosphere as propellant.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

An atmosphere-breathing pulsed plasma thruster includes an inlet, a discharge section in fluid communication with the inlet, and a nozzle in fluid communication with the discharge section. A first electrode, which is one of an anode and a cathode, is disposed at least partially in the discharge section. A plurality of electrode assemblies extend into the discharge section. Each of the electrode assemblies include a second electrode, which is the other of an anode and a cathode and is disposed in the discharge section, and an elongate portion extending out of the discharge section. An electrode control mechanism moves the plurality of electrode assemblies between an inner position (nearer to the first electrode) and an outer position (farther from the first electrode). At least one igniter is associated one of the first and second electrodes. An ignition circuit connects the first electrode and the second electrodes to a first source of electric energy, and connects the igniter to a second source of electric energy through a controllable switch. A processor is operably connected to the electrode control mechanism and configured to control the position of the second electrodes.

In an embodiment, an atmospheric pressure sensor configured to provide pressure data to the processor to control the position of the second electrodes.

In an embodiment the inlet comprises a tubular outer wall and a conical inner wall that cooperatively define a converging annular flow path.

In an embodiment the second electrode assembly elongate portions extend radially into the main discharge section.

In an embodiment the electrode control mechanism comprises a pair of annular actuator guides rotatably mounted on the main discharge section and configured to engage the plurality of electrode assemblies, each actuator guide having an associated electric motor configured to rotate the actuator guide on the main discharge section. For example, the inlet may further comprise a motor support portion configured to retain the electric motors.

In an embodiment the pair of annular actuators define a plurality of arcuate channels that are configured to slidably receive engagement members on a distal end of a corresponding one of the plurality of electrode assemblies. For example the annular actuators may be configured to rotate in opposite directions on the main discharge section.

In an embodiment a plurality of flexible walls connect adjacent second electrodes such that the plurality of flexible walls and the plurality of electrodes cooperatively define an annular wall.

In an embodiment the igniter comprises a conductive wire extending inwardly from at least one of the second electrodes.

In an embodiment the igniter comprises a plurality of igniters, each igniter extending toward the first electrode from a corresponding one of the second electrodes.

In an embodiment the controllable switch comprises an insulated-gate bipolar transistor.

In an embodiment the first source of electric energy comprises a bank of capacitors and the second source of electric energy comprises at least one capacitor.

A method of generating thrust includes providing a thruster having an inlet, a discharge section in fluid communication with the inlet, a first electrode disposed at least partially in the discharge section, and a plurality of electrode assemblies. Each electrode assembly includes a second electrode disposed in the discharge section and an elongate portion extending through a wall of the discharge section. The first electrode is one of an anode and a cathode, and the second electrodes are the other of an anode and a cathode. The method further includes controlling the radial position of the second electrodes by engaging a distal portion of the elongate portions of the plurality of electrode assemblies with an electrode control mechanism configured to move the plurality of electrode assemblies between an inner position wherein the second electrodes are located nearer to the first electrode and an outer position wherein the second electrodes are located farther from the first electrode, and inducing a current flow between the first electrode and at least one of the second electrodes with an igniter. An ignition circuit connects the first electrode and the second electrodes to a first source of electric energy, and connects the igniter to a second source of electric energy through a controllable switch, and the electrode control mechanism is controlled by a processor configured to control a distance between the first electrode and the second electrodes.

In an embodiment an atmospheric pressure sensor configured to provide pressure data to the processor, wherein the processor uses the pressure data to control the position of the second electrodes.

In an embodiment the inlet comprises a tubular outer wall and a conical inner wall that cooperatively define a converging annular flow path.

In an embodiment the electrode control mechanism comprises a pair of annular actuator guides rotatably mounted on the main discharge section and configured to engage the plurality of electrode assemblies, each actuator guide having an associated electric motor configured to rotate the actuator guide on the main discharge section. For example, the pair of annular actuators may define a plurality of arcuate channels that are configured to slidably receive engagement members on a distal end of a corresponding one of the plurality of electrode assemblies, and the annular actuators may be configured to rotate in opposite directions on the main discharge section.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

Figure 1:
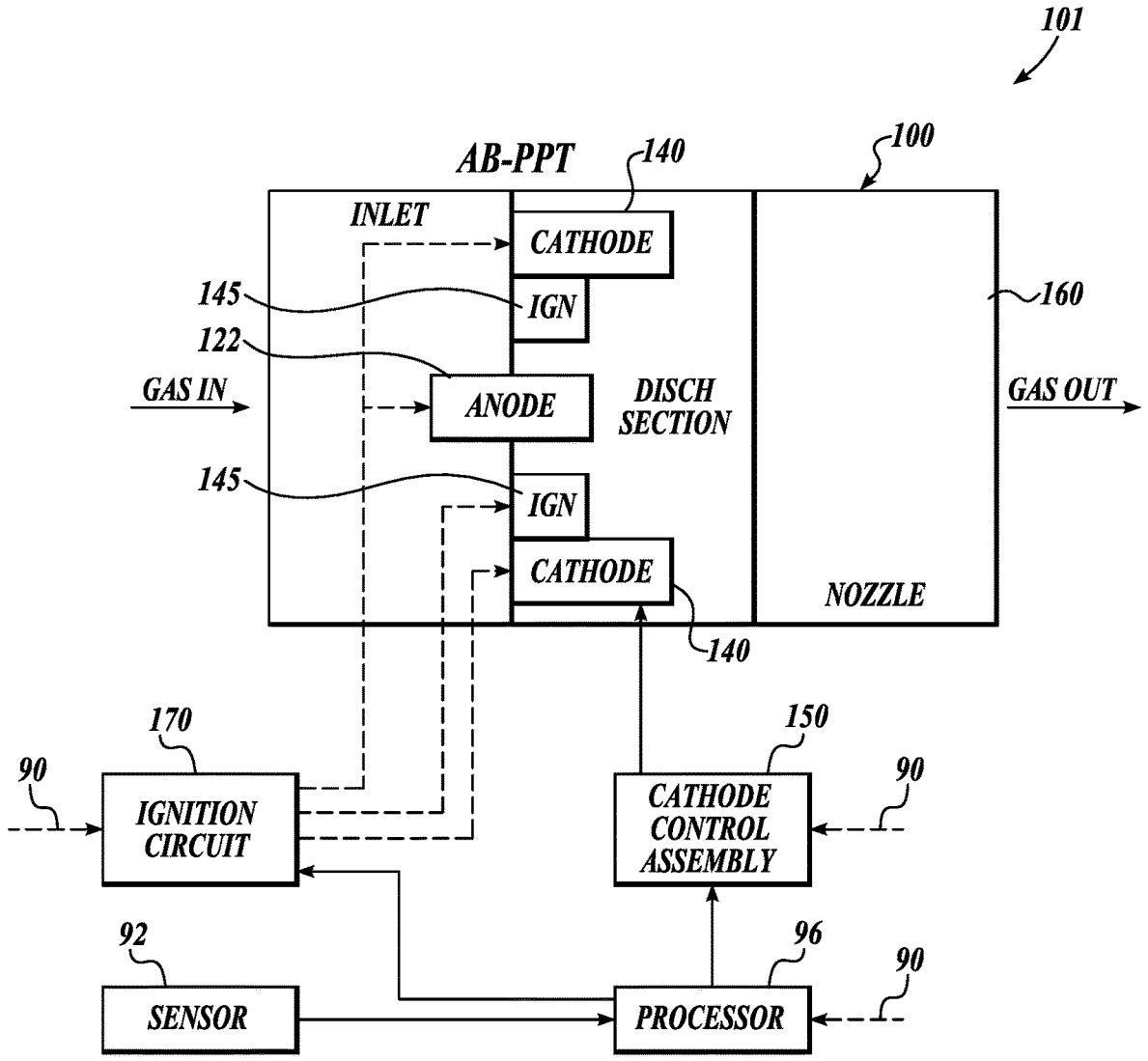
FIG. 1 is a schematic diagram illustrating an air-breathing pulsed plasma thruster (AB-PPT) system in accordance with the present invention.

A schematic diagram of an embodiment of an air-breathing (or atmosphere-breathing) pulsed plasma thruster (AB-PPT) system 101 in accordance with the present invention is shown in FIG. 1. The AB-PPT system 101 includes an AB-PPT 100 powered by a source of electrical energy 90. For example, in an atmospheric satellite application the source of electrical energy 90 may comprise one or more solar panels that form or are fixed to airfoils for an atmospheric satellite (not shown). The energy source 90 provides electricity to a processor 96 that receives signals from a sensor 92, and to an ignition circuit 170. In this embodiment the sensor 92 is an air pressure sensor configured to detect a local atmospheric pressure. The ignition circuit 170 provides energy to an anode 122, to a plurality of cathode assemblies 140, and to one or more igniters 145 configured to induce an electric arc. Although the following description sometimes refers to an air flow, it is contemplated that the AB-PPT system 101 may be configured to operate in other environments having an atmosphere, for example, on Mars, and "air" will be understood to refer to the local atmosphere.

Figure 2:
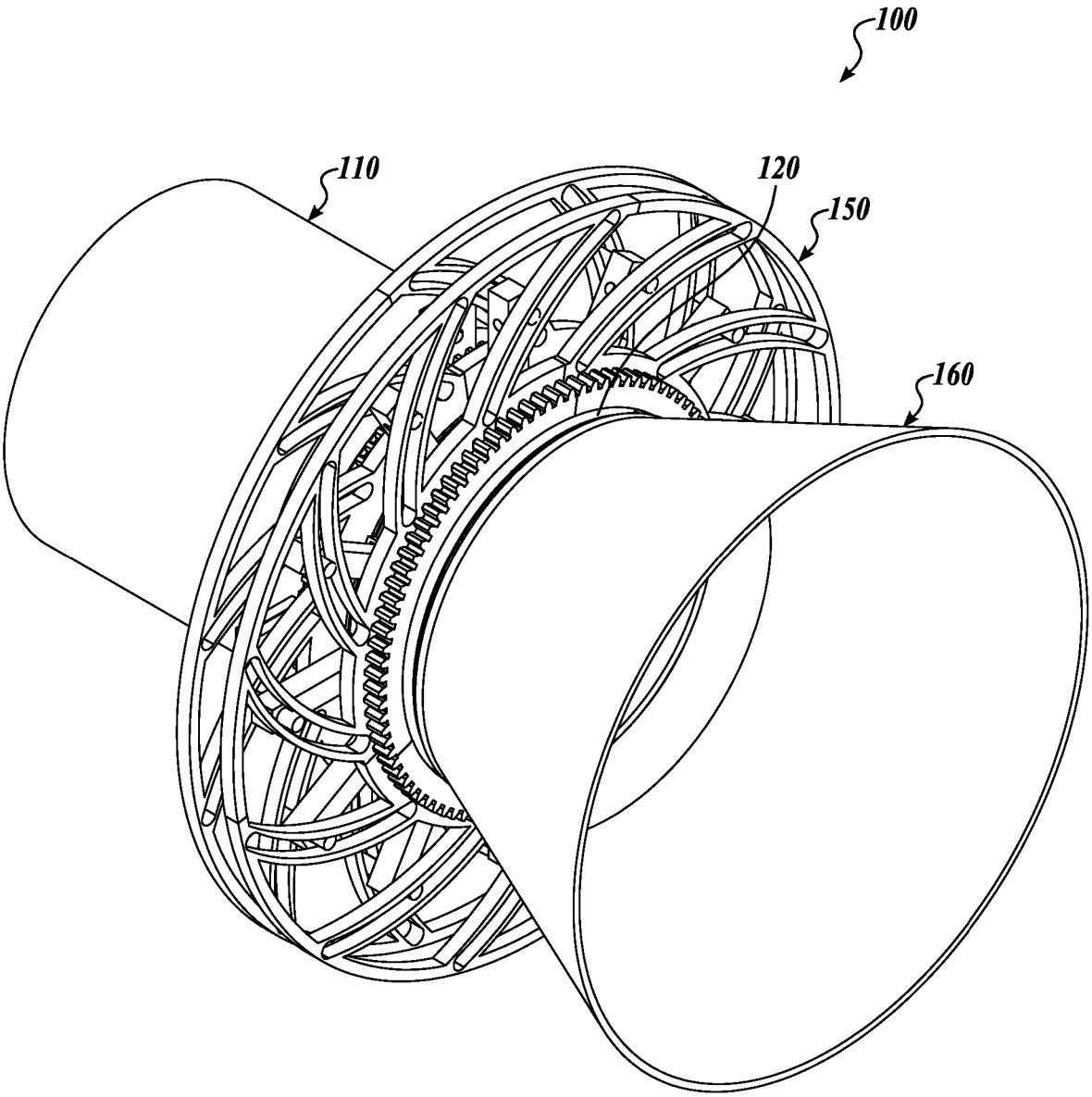
FIG. 2 is a perspective view of an AB-PPT in accordance with the present invention.
Figure 3:
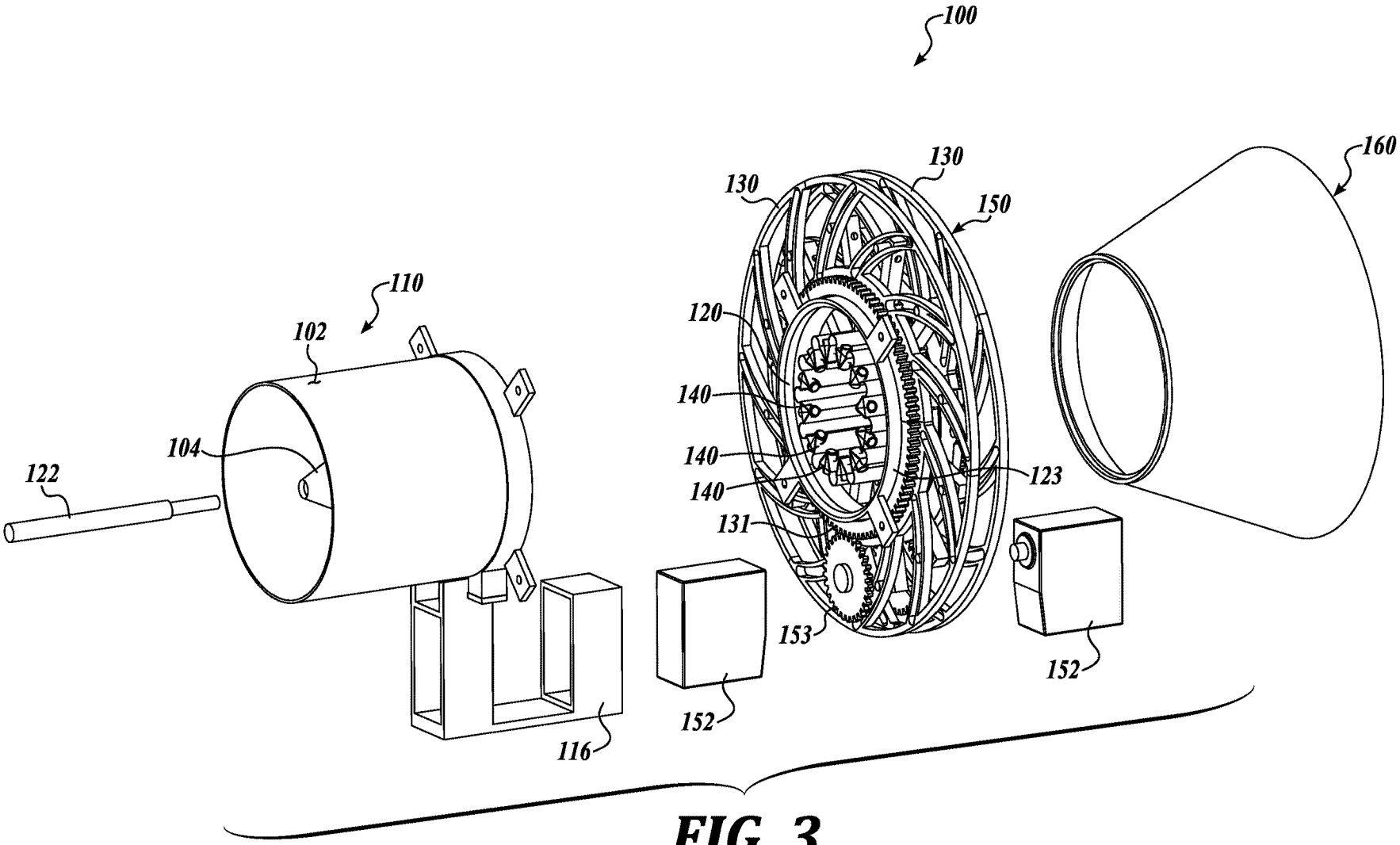
FIG. 3 is a partially exploded view of the AB-PPT shown in FIG. 2.

A perspective view of the AB-PPT 100 for the system 101 is shown in FIG. 2, and a partially exploded view of the AB-PPT 100 is shown in FIG. 3. The AB-PPT 100 includes (i) an inlet 110, (ii) a main discharge section 120, (iii) a cathode control assembly 150 rotatably attached to the main discharge section 120, and (iv) an outflow nozzle 160. The main discharge section 120 receives flow from the inlet 110, and includes the anode 122 that extends from the inlet 110 axially into the discharge section 120. The plurality of cathode assemblies 140 are positioned around the anode 122. The cathode control assembly 150 receives signals from the processor 96 and controllably adjusts the position of the plurality of cathode assemblies 140, such that the radial spacing between the anode 122 and a plurality of cathode members 143 (FIG. 5) is controllable.

Figure 4:
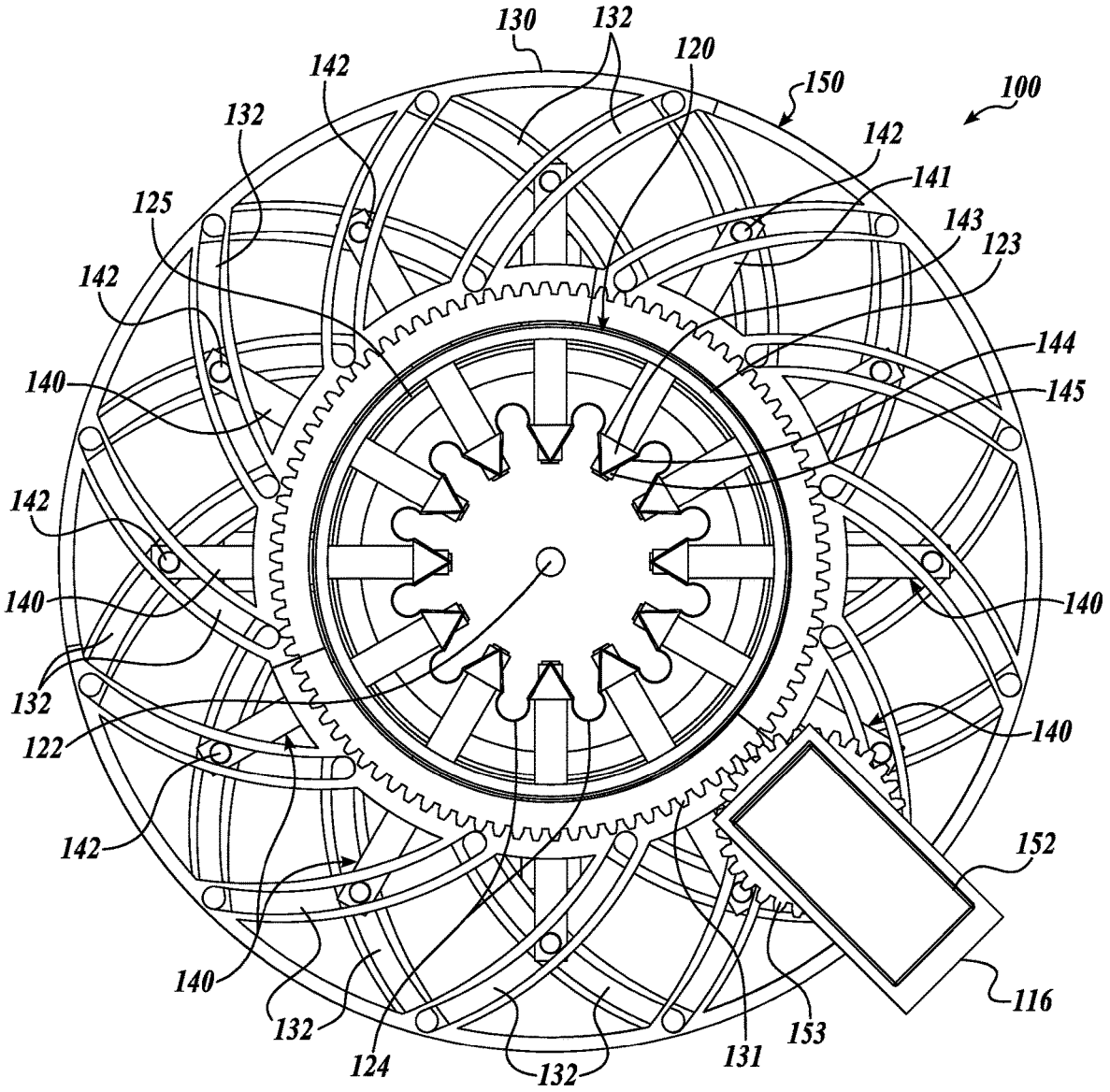
FIG. 4 is a front view of the AB-PPT shown in FIG. 2 with the nozzle removed.

The inlet 110 includes a cylindrical outer wall 102 and a coaxial conical member 104. The outer wall 102 and conical member 104 define an outwardly converging annular channel that directs air into the main discharge section 120 through peripheral ports 125 (FIG. 4). A motor support 116 extends from the outer wall 102 of the inlet 110, and is configured to support a pair of oppositely disposed drive motors 152 that operatively actuate the cathode control assembly 150. For example, the drive motors 152 may be stepper motors. The cathode control assembly 150 extends radially from the main discharge section 120. The outflow nozzle 160 is a diverging nozzle extending away from the discharge section 120.

Refer now also to FIG. 4, showing a front view of the AB-PPT 100 with the nozzle 160 removed. The main discharge section 120 includes a tubular wall 123 that in this embodiment is generally aligned with the outer wall 102 of the inlet 110. A generally annular port or gap 125 near the tubular wall 123 provides a flow path from the inlet 110 converging channel into the main discharge section 120. In a current embodiment the annular port 125 is shaped to direct the flow entering the discharge section 120 radially inwardly. One or more cathode assemblies 140 (twelve shown) extend radially through openings in the tubular wall 123. Other embodiments may have more or fewer cathode assemblies 140. The cathode assemblies 140 are spaced radially from the anode 122. In this embodiment the cathode assemblies 140 are symmetrically disposed about the anode 122.

Figure 5:
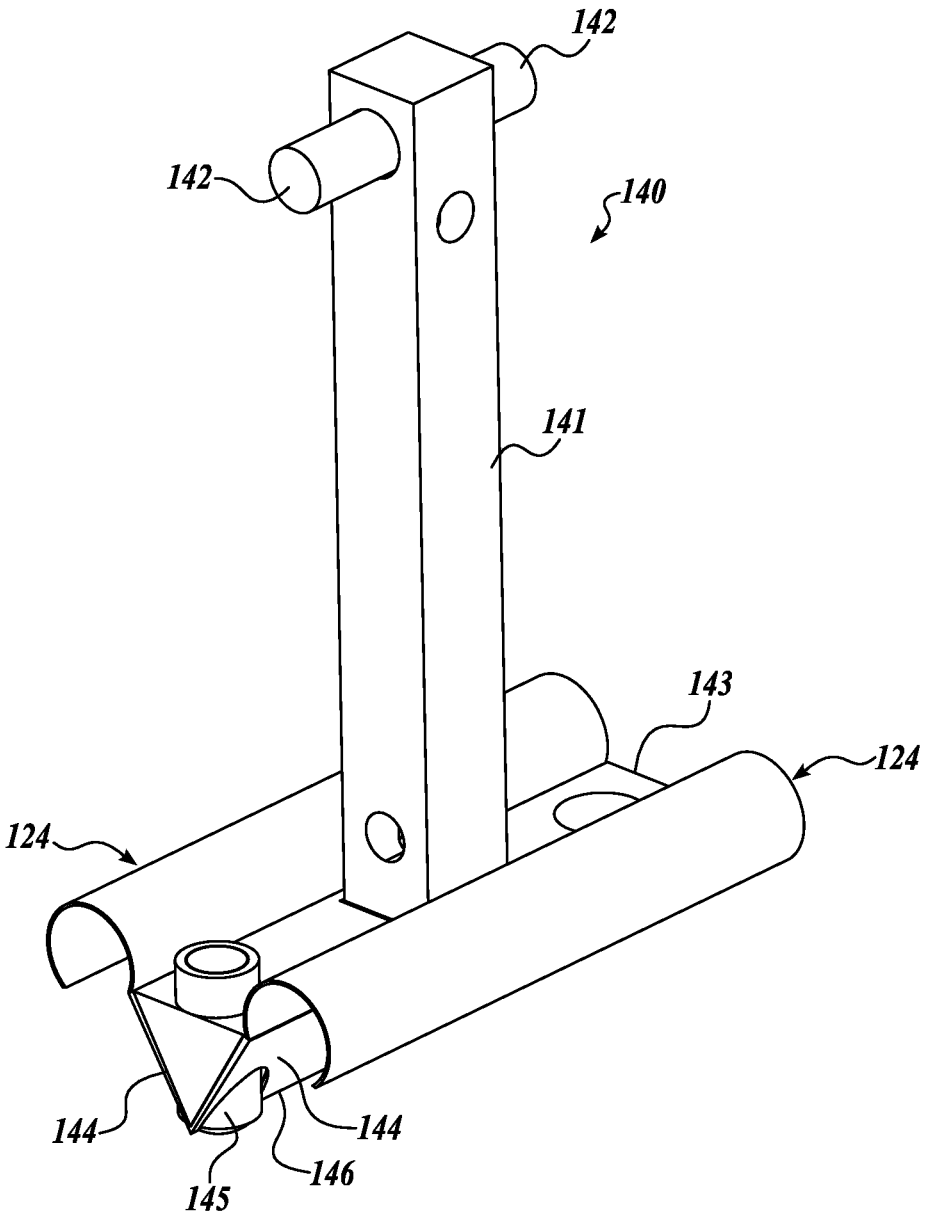
FIG. 5 is a perspective view of a cathode assembly for the AB-PPT shown in FIG. 2 and showing two of the flexible wall sections.

FIG. 5 is a perspective view of a cathode assembly 140 with associated adjacent flexible inner wall sections 124. The cathode assembly 140 includes an elongate rod 141 that is configured to extend through the tubular wall 123. A distal end portion of the elongate rod 141 includes engagement portions 142. In this embodiment the engagement portions 142 are opposite ends of a guide pin that extend transversely through the rod 141. A proximal end of the elongate rod 141 is fixed to a transverse cathode member 143. As seen most clearly in FIG. 4, the flexible inner wall sections 124 connect neighboring transverse cathode members 143, such that the flexible inner wall sections 124 and the transverse cathode members 143 cooperatively form an expandable wall disposed radially outward from the anode 122. In particular, the flexible inner wall sections 124 are sufficiently expandable to remain attached to the cathode members 143 through the full range of motion of the cathode assemblies 140.

Referring still to FIG. 5, in this embodiment the transverse cathode members 143 have a triangular cross section oriented with an inner edge 146 of the triangular cross section directed inwardly, and generally parallel to an axis of the anode 122. It has been found advantageous for the cathode member 143 to include an inner edge 146 that extends approximately parallel to a central axis of the main discharge section 120. At least the inner faces 144 of the cathode member 143 comprise a cathode material, for example copper or the like.

In this embodiment an igniter 145 is located at or near the inner faces 144 of each of the cathode members 143. The igniter 145 is configured to generate an ionizing spark to facilitate a flow of electricity between the cathode member 143 and the anode 122. For example the igniter 145 in a current embodiment is insulated from the associated cathode member 143 and may extend from the cathode member 143 toward the anode 122. When a sufficient potential is applied between the igniter 145 and the cathode member 143 (i.e., from an igniter capacitor 172 shown in FIG. 6) an electric arc will be induced therebetween. The electric arc ionizes gas in the discharge section 120 to trigger a flow of current between the associated cathode member 143 and the anode 122 when the electrodes 122, 143 are provided with a suitable electric potential difference (e.g., from a main capacitor bank 171 shown in FIG. 6). For example, an igniter 145 is triggered for each pulse of the AB-PPT 100, and a distributor (not shown) is provided to sequentially connect the igniters 145 to the ignition circuit 170. Alternatively, the igniters 145 may be configured to discharge in subgroups, for example in opposite pairs or triplets. In another embodiment a single igniter 145 is provided and is located adjacent to the anode 122 or to one of the cathode members 143.

The cathode control assembly 150 will now be described with reference to FIGS. 3 and 4. Two spaced apart annular actuator guides 130 rotatably engage a bearing surfaces on the main discharge section 120. In some embodiments bearing assemblies, for example, roller bearings or the like (not shown), are provided between the discharge section wall 123 and the actuator guides 130. Each of the actuator guides 130 includes a gear portion 131 near the inner radius of the actuator guide 130. The gear portions 131 engage a corresponding one of the drive gears 153. The drive motors 152 are configured to controllably rotate the actuator guides 130 about the central axis of the discharge section 120 (in either direction). The actuator guides 130 define arcuate slots or channels 132 that slidably receive corresponding guide pins 142.

In this embodiment the arcuate channels are uniformly spaced and positioned to cooperate with a corresponding arcuate channel 132 on the other actuator guide 130 to engage an associated guide pin 142. The drive motors 152 controllably rotate the actuator guides 130 in opposite directions such that the actuator guides 130 uniformly move the cathode assemblies 140 radially inwardly or outwardly, to selectively adjust the distance between the cathode members 143 and the anode 122. In this embodiment, the cathode control assembly 150 is configured to selectively move the plurality of cathode assemblies 140 uniformly in the radial direction, such that the plurality of cathode members 143 remains uniformly spaced from the anode 122, and the electrode spacing is controllable. As shown in FIG. 1, the processor 96 controls the cathode control assembly 150 to achieve an adjustable spacing between the anode 122 and the cathode members 143 that is dependent on data receive from the sensor 92.

The performance of the AB-PPT 100 will depend on the distance between the anode 122 and the cathode members 143. The optimal distance between the anode 122 and the cathode members 143 varies with environmental conditions, and in particular with the background atmospheric pressure. The AB-PPT 100 disclosed herein is configured to detect relevant conditions, for example atmospheric pressure with the sensor 92, and to adjust the anode/cathode spacing using data received from the sensor 92 by moving the cathode assemblies 140 towards or away from the anode 122. This control allows the AB-PPT 100 to operate in a wide range of altitudes with the cathode control assembly 150 permitting real time control of the spacing between the electrodes 122, 143.

Figure 6:
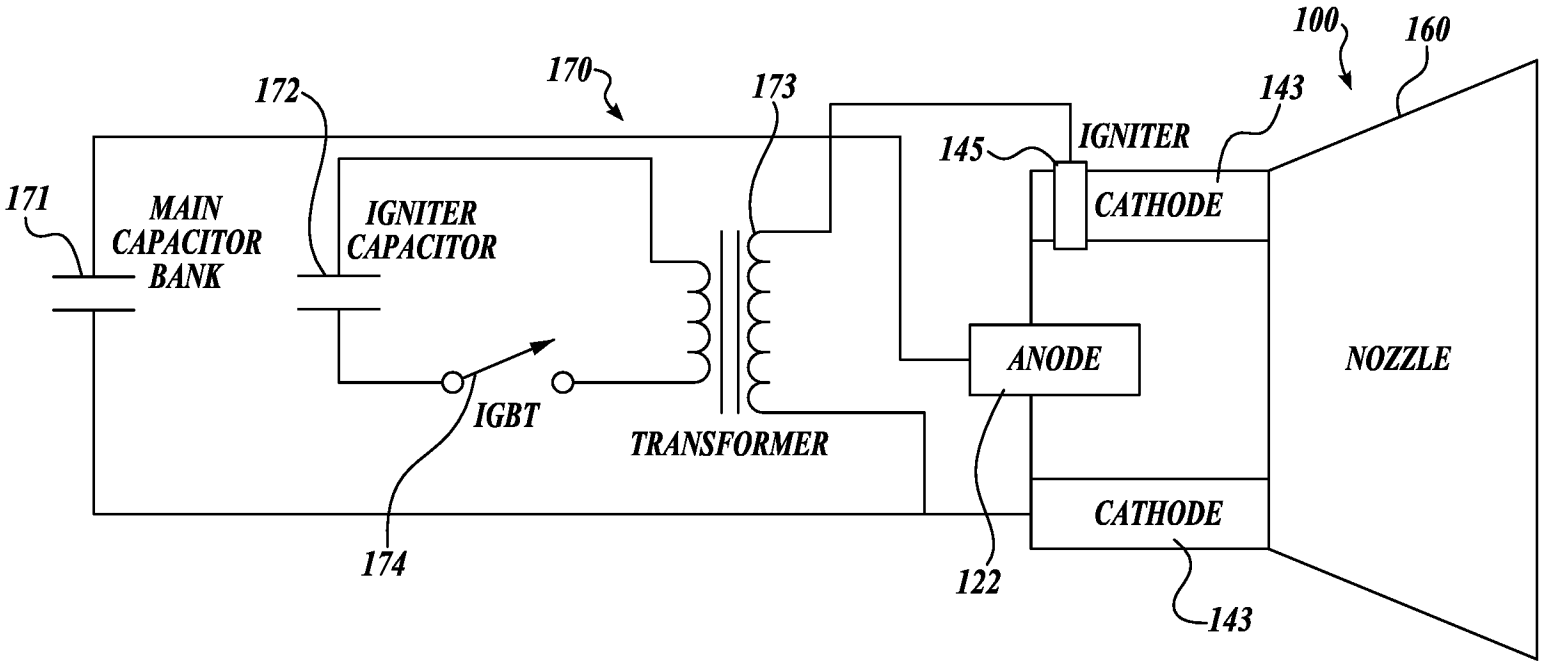
FIG. 6 is a simplified circuit diagram of the ignition circuit for the AB-PPT shown in FIG. 2.

A simplified circuit diagram 170 for the AB-PPT 100 is shown in FIG. 6. In this embodiment the circuit 170 includes a main capacitor bank 171 (illustrated as a single capacitor) connected between the anode 122 and the cathode assemblies 140. An igniter capacitor 172 is connected to a transformer 173, for example a step-up toroidal transformer, through a controllable switch 174, for example an insulated-gate bipolar transistor (IGBT). The IGBT 174 is controlled by the processor 96 (FIG. 1). The igniter 145 is configured to generate an initial breakdown of gas in the main discharge section 120 allowing a current to flow between the associated cathode assembly 140 and the anode 122. The ionized gases in the main discharge section 120 permit the main capacitor bank 171 to discharge between the anode 122 and the cathode members 143. Gas in the discharge section 120 therefore expands, e.g., due to ionization and heating, and is thereby accelerated out the nozzle 160 to generate the desired thrust. The enclosure defined by the flexible inner wall sections 124 and the cathode members 143 have been found to facilitate the desired ionization and to improve the efficiency of the AB-PPT 100.

It will be appreciated by persons of skill in the art, and in view of the disclosure herein, that the electrodes 122, 143 may be reversed in the AB-PPT 100 and will be operable. Therefore, in the present application "anode" and "cathode" are expressly defined to be electrodes through which a conventional current enters or leaves, wherein if the conventional current enters the "anode" then the current leaves the "cathode," and vice versa.

While illustrative embodiments have been illustrated and described, it will be appreciated that various changes can be made therein without departing from the spirit and scope of the invention.

The embodiments of the invention in which an exclusive property or privilege is claimed are defined as follows:

1. An atmosphere-breathing pulsed plasma thruster comprising:

an inlet, a discharge section in fluid communication with the inlet, and a nozzle in fluid communication with the discharge section;

a first electrode disposed at least partially in the discharge section;

a plurality of electrode assemblies, each electrode assembly of the plurality of electrode assemblies having a second electrode disposed in the discharge section and an elongate rod extending out of the discharge section, wherein i) the first electrode is anodic and each second electrode is cathodic, or ii) the first electrode is cathodic and each second electrode is anodic;

an electrode control mechanism configured to move the plurality of electrode assemblies between an inner position wherein each second electrode is located nearer to the first electrode and an outer position wherein each second electrode is located farther from the first electrode;

at least one igniter associated with either the first electrode or with one of the second electrodes;

an ignition circuit that connects the first electrode and each second electrode to a first source of electric energy, and connects the at least one igniter to a second source of electric energy through a controllable switch; and a processor operably connected to the electrode control mechanism and configured to control a position of each second electrode;

wherein each second electrode is oriented lengthwise parallel to a central axis of the discharge section.

2. The atmosphere-breathing pulsed plasma thruster of claim 1, further comprising an atmospheric pressure sensor configured to provide pressure data to the processor.

3. The atmosphere-breathing pulsed plasma thruster of claim 2, wherein the processor uses the pressure data to control the position of each second electrode.

4. The atmosphere-breathing pulse plasma thruster of claim 1, wherein the inlet comprises a tubular outer wall and a conical inner wall that cooperatively define a converging annular flow path.

5. The atmosphere-breathing pulse plasma thruster of claim 1, wherein each second electrode extends radially into the discharge section.

6. The atmosphere-breathing pulse plasma thruster of claim 1, wherein the electrode control mechanism comprises a pair of annular actuator guides rotatably mounted on the discharge section and configured to engage the plurality of electrode assemblies, each annular actuator guide of the pair of annular actuator guides having an associated electric motor configured to rotate the respective annular actuator guide of the pair of annular actuator guides on the discharge section.

7. The atmosphere-breathing pulsed plasma thruster of claim 6, wherein the inlet further comprises a motor support portion configured to retain each electric motor.

8. The atmosphere-breathing pulsed plasma thruster of claim 6, wherein the pair of annular actuator guides each define a plurality of arcuate channels that are configured to slidably receive engagement members on a distal end of a corresponding one of the plurality of electrode assemblies.

9. The atmosphere-breathing pulsed plasma thruster of claim 6, wherein the pair of annular actuator guides are configured to rotate in opposite directions on the discharge section.

10. The atmosphere-breathing pulsed plasma thruster of claim 1, further comprising a plurality of flexible walls that connect each second electrode to another second electrode that is adjacent, such that the plurality of flexible walls and the plurality of electrodes cooperatively define an annular wall.

11. The atmosphere-breathing pulsed plasma thruster of claim 1, wherein the at least one igniter comprises a conductive wire extending inwardly from at least one second electrode.

12. The atmosphere-breathing pulsed plasma thruster of claim 1, wherein the at least one igniter comprises a plurality of igniters, each igniter of the plurality of igniters extending toward the first electrode from a corresponding second electrode.

13. The atmosphere-breathing pulsed plasma thruster of claim 1, wherein the controllable switch comprises an insulated-gate bipolar transistor.

14. The atmosphere-breathing pulsed plasma thruster of claim 1, wherein the first source of electric energy comprises a bank of capacitors and the second source of electric energy comprises at least one capacitor.

15. The atmosphere-breathing pulsed plasma thruster of claim 1, wherein each second electrode has a polygonal cross section and each second electrode is oriented such that the second electrode defines an inner edge that is parallel to the central axis of the discharge section.

16. The atmosphere-breathing pulsed plasma thruster of claim 1, wherein the at least one igniter comprises a plurality of igniters, wherein each igniter of the plurality of igniters is attached to a respective second electrode of the plurality of electrode assemblies.

17. A method of generating thrust comprising:

providing a thruster having an inlet, a discharge section in fluid communication with the inlet, a first electrode disposed at least partially in the discharge section, and a plurality of electrode assemblies, each electrode assembly of the plurality of electrode assemblies having a second electrode disposed in the discharge section and an elongate rod extending through a wall of the discharge section, wherein i) the first electrode is anodic and each second electrode is cathodic, or ii) the first electrode is cathodic and each second electrode is anodic:

controlling a radial position of each electrode assembly by engaging a distal portion of the respective elongate rod of the electrode assembly with an electrode control mechanism configured to move the plurality of electrode assemblies between an inner position wherein each second electrode is located nearer to the first electrode and an outer position wherein each second electrode is located farther from the first electrode;

inducing a current flow between the first electrode and at least one of the second electrodes with an igniter;

wherein an ignition circuit connects the first electrode and each second electrode to a first source of electric energy, and connects the igniter to a second source of electric energy through a controllable switch, and the electrode control mechanism is controlled by a processor configured to control a distance between the first electrode and the each second electrode;

wherein each second electrode is oriented lengthwise parallel to a central axis of the discharge section.

18. The method of claim 17, further comprising an atmospheric pressure sensor configured to provide pressure data to the processor, wherein the processor uses the pressure data to control the position of each second electrode.

19. The method of claim 17, wherein the inlet comprises a tubular outer wall and a conical inner wall that cooperatively define a converging annular flow path.

20. The method of claim 17, wherein the electrode control mechanism comprises a pair of annular actuator guides rotatably mounted on the discharge section and configured to engage the plurality of electrode assemblies, each annular actuator guide of the pair of annular actuator guides having an associated electric motor configured to rotate the respective annular actuator guide of the pair of annular actuator guides on the discharge section.

21. The method of claim 20, wherein the pair of annular actuator guides define a plurality of arcuate channels that are configured to slidably receive engagement members on a distal end of a corresponding one of the plurality of electrode assemblies.

22. The method of claim 20, wherein a first one of the pair of annular actuator guides is configured to rotate in an opposite direction to a second one of the pair of annular actuator guides.

* * * * *